US008770878B2

(12) United States Patent
Leighton et al.

(10) Patent No.: US 8,770,878 B2
(45) Date of Patent: Jul. 8, 2014

(54) SYSTEM AND METHOD FOR MONITORING A WEB MEMBER AND APPLYING TENSION TO THE WEB MEMBER

(75) Inventors: Roger G. Leighton, Hilton, NY (US); Yongsoon Eun, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 465 days.

(21) Appl. No.: 13/023,342

(22) Filed: Feb. 8, 2011

(65) Prior Publication Data

US 2012/0201591 A1 Aug. 9, 2012

(51) Int. Cl.
*B41J 15/00* (2006.01)
*B41J 15/16* (2006.01)

(52) U.S. Cl.
CPC ..... *B41J 15/165* (2013.01)
USPC ..... 400/618; 400/619

(58) Field of Classification Search
CPC ..... B41J 15/165
USPC ..... 400/618
See application file for complete search history.

(56) References Cited

U.S. PATENT DOCUMENTS 3,837,550 A 9/1974 Levy
3,912,145 A 10/1975 Meihofer
4,369,906 A 1/1983 Isherwood
5,260,716 A 11/1993 Maslanka
5,470,005 A 11/1995 King et al.
5,709,331 A * 1/1998 Lam et al. ..... 226/4
5,712,489 A 1/1998 Elvidge et al.
5,820,280 A * 10/1998 Fox ..... 400/611
5,878,933 A 3/1999 Laughery
6,085,956 A 7/2000 Sainio et al.
6,160,978 A 12/2000 Tsuruoka et al.
6,211,968 B1 * 4/2001 Glockner et al. ..... 358/1.4
6,233,495 B1 5/2001 Chen
6,293,539 B1 9/2001 Fukatsu et al.
6,381,440 B1 4/2002 Böck et al.
6,596,108 B2 7/2003 McCabe
6,851,367 B2 2/2005 Vaidyanathan et al.
6,991,144 B2 * 1/2006 Franz et al. ..... 226/24
7,017,485 B2 3/2006 Albert et al.
7,067,039 B2 * 6/2006 Almi et al. ..... 162/193
7,118,062 B2 10/2006 Vaidyanathan et al.
7,130,571 B2 10/2006 Berg et al.
7,467,838 B2 12/2008 Folkins et al.
7,510,256 B2 3/2009 Guarino et al.
7,739,952 B2 * 6/2010 Sakamoto ..... 101/484
8,461,562 B2 * 6/2013 Hashimoto ..... 250/559.05
2001/0006029 A1 7/2001 Ogawa et al.
2002/0108983 A1 * 8/2002 Cote et al. ..... 226/4
2006/0221124 A1 10/2006 Guarino et al.
2010/0046014 A1 2/2010 Eun et al.
2010/0108733 A1 5/2010 Fuwa
2010/0243698 A1 9/2010 Hashimoto
2011/0020043 A1 * 1/2011 Kurmeier ..... 400/611

* cited by examiner

*Primary Examiner* — Anthony Nguyen
(74) *Attorney, Agent, or Firm* — Maginot, Moore & Beck, LLP

(57) ABSTRACT

A method for adjusting tension to a media web in a printing system includes identifying a tension level between the media web and at least one roll that is in contact with the media web. The tension level is identified with reference to a slip condition between the media web and the at least one roll. The identified tension is stored in a memory in the printing system.

8 Claims, 5 Drawing Sheets

SYSTEM AND METHOD FOR MONITORING A WEB MEMBER AND APPLYING TENSION TO THE WEB MEMBER

TECHNICAL FIELD

This disclosure relates generally to methods for selecting tension to apply to a web member moving through a device, and more particularly to methods for selecting tension to apply to media webs in printers.

BACKGROUND

In general, inkjet printing machines or printers include at least one printhead unit that ejects drops of liquid ink onto recording media or an imaging member for later transfer to media. Different types of ink may be used in inkjet printers. In one type of inkjet printer, phase change inks are used. Phase change inks remain in the solid phase at ambient temperature, but transition to a liquid phase at an elevated temperature. The printhead unit ejects molten ink supplied to the unit onto media or an imaging member. Once the ejected ink is on media, the ink droplets quickly solidify.

The media used in both direct and offset printers may be in web form. In a web printer, a continuous supply of media, typically provided in a media roll, is entrained onto rolls that are driven by motors. The motors and rolls pull the web from the supply roll through the printer to a take-up roll. The rollers are arranged along a linear media path, and the media web moves through the printer along the media path. As the media web passes through a print zone opposite the printhead or heads of the printer, the printheads eject ink onto the web. Along the feed path, tension bars or other rolls remove slack from the web so the web remains taut without breaking.

Existing web printing systems use a registration control method to control the timing of the ink ejections onto the web as the web passes the printheads. One known registration control method that may be used to operate the printheads is the single reflex method. In the single reflex method, the rotation of a single roll at or near a printhead is monitored by an encoder. The encoder may be a mechanical or electronic device that measures the angular velocity of the roll and generates a signal corresponding to the angular velocity of the roll. The angular velocity signal is processed by a controller executing programmed instructions for implementing the single reflex method to calculate the linear velocity of the web. The controller may adjust the linear web velocity calculation by using tension measurement signals generated by one or more load cells that measure the tension on the web near the roll. The controller implementing the single reflex method is configured with input/output circuitry, memory, programmed instructions, and other electronic components to calculate the linear web velocity and to generate the firing signals for the printheads in the marking stations.

Another existing registration control method that may be used to operate the printheads in a web printing system is the double reflex method. In the double reflex method, each encoder in a pair of encoders monitors one of two different rolls. One roll is positioned on the media path prior to the web reaching the printheads and the other roll is positioned on the media path after the media web passes the printheads. The angular velocity signals generated by the two encoders for the two rolls are processed by a controller executing programmed instructions for implementing the double reflex method to calculate the linear velocity of the web at each roll and then to interpolate the linear velocity of the web at each of the printheads. These additional calculations enable better timing of the firing signals for the printheads in the marking stations and, consequently, improved registration of the images printed by the marking stations in the printing system.

Moving the web through the media path in a controlled manner presents challenges to web printing systems. If the web slips when engaged with one or more rolls in the media path, the position of the media web with respect to the printheads is affected and errors in images formed on the media web may occur. Media slippage may cause errors between the actual velocity of the web and the web velocity that is identified with respect to the angular velocity of the rolls, reducing the effectiveness of single and double reflex registration techniques. Increasing tension at a roll is known to increase friction between the roll and media web and reduce the likelihood of the media web slipping on the roll. Too much tension, however, can break or distort the media web, resulting in lost productivity when the printer is unable to print to the media web. In existing printers, different printer configurations and media types may have known tension settings that enable the media web to move through the media path without slipping or breaking. During operation, however, the mechanical tolerances and frictional coefficients of various printer components may change, and the known tension settings may no longer be suitable. Thus, improvements in operating continuous web printing systems to enable accurate reflex registration control would be beneficial.

SUMMARY

A method of adjusting operation of a printing system has been developed. The method includes identifying a tension level for at least one roll positioned along a media web path through the printing system and storing the tension level for the at least one roll in a memory of the printing system. The tension level is identified with reference to a predetermined slip condition between a media web moving along the media web path and the at least one roll.

A printing system that is configured to adjust tension on a media web has been developed. The system includes at least one roll positioned proximate to a media path through the printing system along which media moves through the printing system, a tension sensor operatively coupled to the at least one roll, a memory, and a controller operatively coupled to the tension sensor and the memory. The at least one roll is configured to contact the media web and rotate in response to movement of the media web. The tension sensor is configured to generate a signal corresponding to a tension level of the at least one roll on the media web. The controller being configured to identify a tension level with reference to a predetermined slip condition between a media web moving along the media path and the at least one roll and to store the identified tension level for the at least one roll in the memory.

DETAILED DESCRIPTION

Figure 1:
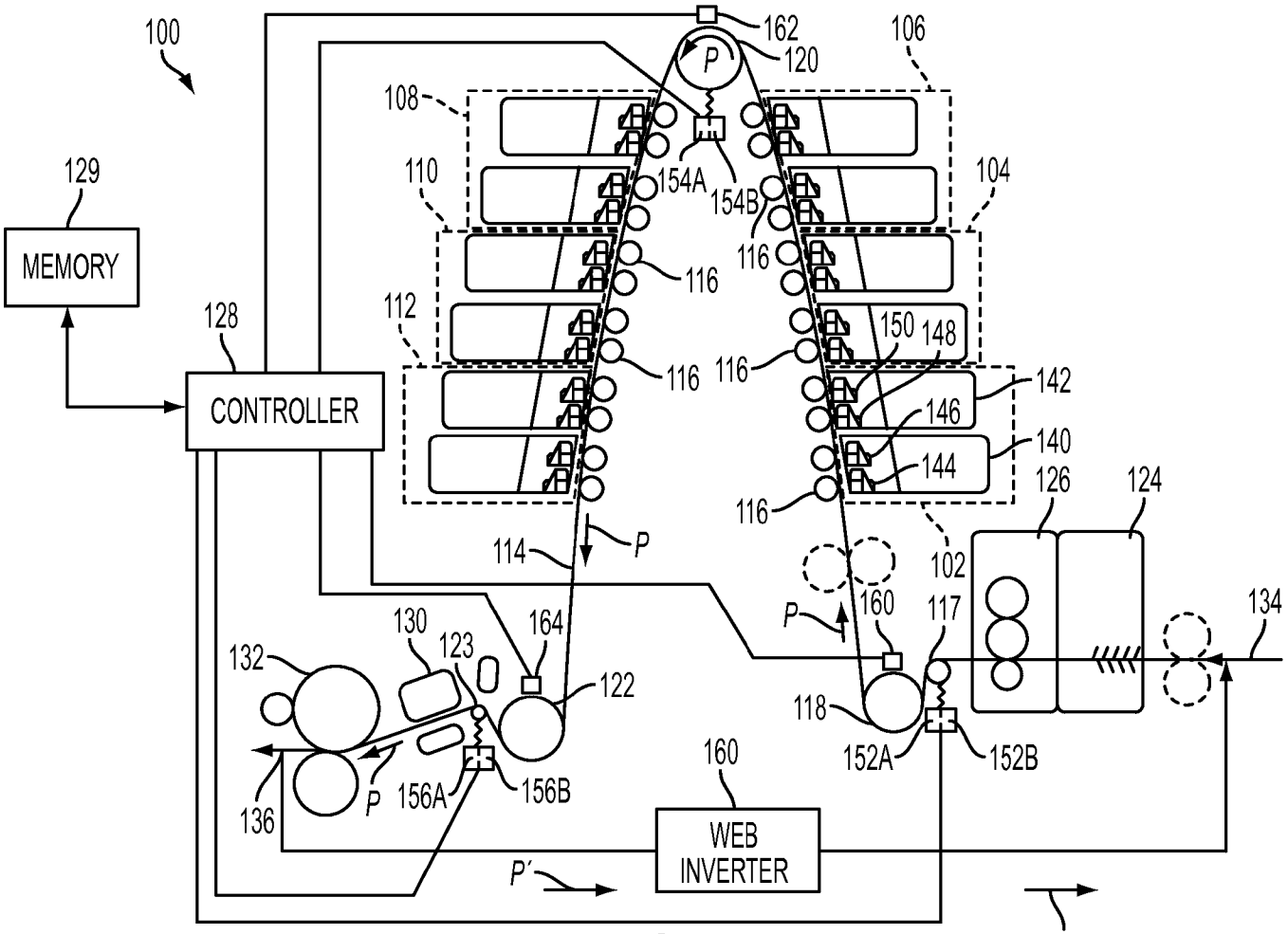
FIG. 1 is a schematic diagram of a duplex continuous web printing system that is configured to adjust a level of tension applied to the web to prevent slip between the media web and one or more rolls.

For a general understanding of the environment for the system and method disclosed herein as well as the details for the system and method, the drawings are referenced throughout this document. In the drawings, like reference numerals designate like elements. As used herein the term "printer" refers to any device that is configured to eject a marking agent upon an image receiving member and includes photocopiers, facsimile machines, multifunction devices, as well as direct and indirect inkjet printers and any imaging device that is configured to form images on a print medium. As used herein, the term "process direction" refers to a direction of travel of an image receiving member, such as an imaging drum or print medium, and the term "cross-process direction" is a direction that is perpendicular to the process direction along the surface of the image receiving member. As used herein, the terms "web," "media web," and "continuous media web" refer to an elongated print medium that is longer than the length of a media path that the web traverses through a printer during the printing process. Examples of media webs include rolls of paper or polymeric materials used in printing. The media web has two sides forming surfaces that may each receive images during printing. Each surface of the media web is made up of a grid-like pattern of potential drop locations, sometimes referred to as pixels.

As used herein, the term "capstan roll" refers to a cylindrical member that is configured to have continuous contact with media web moving over a curved portion of the member, and to rotate in accordance with a linear motion of the continuous media web. As used herein, the term "angular velocity" refers to the angular movement of a rotating member for a given time period, sometimes measured in rotations per second or rotations per minute. The term "linear velocity" refers to the velocity of a member, such as a media web, moving in a straight line. When used with reference to a rotating member, the linear velocity represents the tangential velocity at the circumference of the rotating member. The linear velocity v for circular members may be represented as: $v=2\pi r\omega$ where r is the radius of the member and $\omega$ is the rotational or angular velocity of the member. A media web that is in contact with a roll slips when the tension differential across the roll is greater than what the capstan friction $e^{\mu\theta}$ can support traction. In identifying capstan friction, $\mu$ represents the coefficient of friction of the capstan roll, and $\theta$ represents the angle of the surface of the capstan roll that contacts the media web. Media web slip generates velocity errors between the media web that is in contact with the roll and the surface of the roll.

FIG. 1 depicts a continuous web printer system 100 that includes six print modules 102, 104, 106, 108, 110, and 112; a controller 128, a memory 129, guide rolls 116, pre-heater roll 118, apex roll 120, leveler roll 122, tension sensors 152A-152B, 154A-154B, and 156A-156B; and encoders 160, 162, and 164. The print modules 102, 104, 106, 108, 110, and 112 are positioned sequentially along a media path P and form a print zone for forming images on a print medium 114 as the print medium 114 travels past the print modules. Each print module 102, 104, 106, 108, 110, and 112 in this embodiment provides an ink of a different color. In all other respects, the print modules 102, 104, 106, 108, 110, and 112 are substantially identical. The media web travels through the media path P guided by rolls 116, pre-heater roll 118, apex roll 120, and leveler roll 122. In FIG. 1, the apex roll 120 is an "idler" roll, meaning that the roll rotates in response to engaging the moving media web 114, but is otherwise uncoupled from any motors or other drive mechanisms in the printing system 100. The pre-heater roll 118, apex roll 120, and leveler roll 122 are each examples of a capstan roll that engages the media web 114 on a portion of its surface. A brush cleaner 124 and a contact roll 126 are located at one end of the media path P. A heater 130 and a spreader 132 are located at the opposite end 136 of the media path P.

The embodiment of FIG. 1 includes web inverter 160 that is configured to route the media web 114 from the end 136 of media path P to the beginning 134 of the media path through an inverter path P'. The web inverter flips the media web and the inverter path P' returns the flipped web to the inlet 134 to enable duplex printing where the print modules 102-112 form ink images on a second side of the media web after forming images on the first side. In this operating mode, a first section of the media web moves through the media path P in tandem with a second section of the media web, with the first section receiving ink images on a first side of the media web and the second section receiving ink images on the second side. This configuration may be referred to as a "mobius" configuration. Each of the print modules 102-112 is configured to eject ink drops onto both sections of the media web. Each of the rolls 116, 118, 120, and 122 also engage both the first and second sections of the media web. After the second side of the media web 114 is imaged, the media web 114 passes the end of the media path 136.

Figure 5A:
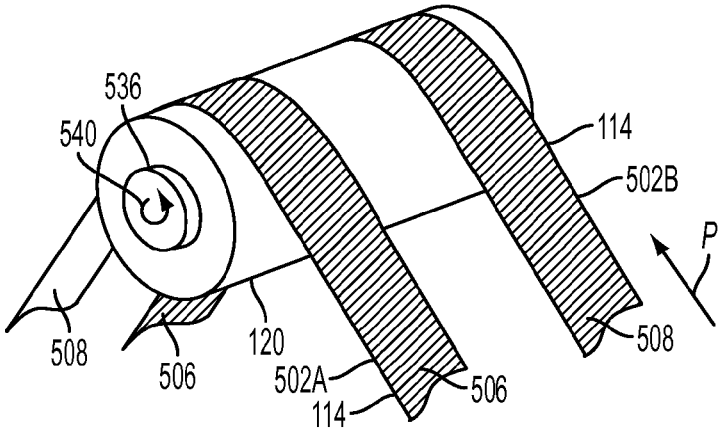
FIG. 5A is a depiction of a capstan roll configured to contact a bare surface of a media web at a first position and a printed surface of the media web at a second position, which is called a mobius configuration.

FIG. 5A depicts an exemplary configuration of the apex roll 120 engaging two portions of the media web 114. Two sections 502A and 502B of a single media web 114 are shown engaging apex roll 120. Both media web sections 502A and 502B move in process direction P, and apex roll 120 rotates about a bearing 536 in direction 540 in response to the rotating force between the media web and the apex roll 120. Media web section 502A has a first side 506 being imaged by the printing system, and a second bare side 508 that engages the apex roll 520. Section 502B has been inverted, with side 508 undergoing second-side imaging, and previously imaged side 506 engaging the apex roll 120. The bare media surface 508 of web section 502A and the imaged surface 506 of the web section 502B may have different coefficients of friction. In some embodiments of media web and ink, including newsprint, the bare media web surface has a higher coefficient of friction than the imaged surface. The ink formed on the imaged surface 506 of the media web has predetermined thickness, with one embodiment having an ink layer that is approximately 12 um thick. The additional thickness of the ink increases the effective radius of section 502B of the media web 114 around the apex roll 120 in comparison to section 502A. The difference in radii forces the media web sections 502A and 502B to move at a different speeds. Therefore, some degree of slip is acceptable for the imaged web section 502B, which moves at a faster rate over the apex roll 120 than section 502A. The apex roll 120 may rotate at an average speed that is between the speed of the media web sections 502A and 502B.

Referring again to FIG. 1, print module 102 includes two print sub modules 140 and 142. Print sub module 140 includes two print units 144 and 146. The print units 144 and 146 each include an array of printheads that are arranged in a staggered configuration across the width of both the first section of web media and second section of web media. In a typical embodiment, print unit 144 has four printheads and print unit 146 has three printheads. The printheads in print units 144 and 146 are positioned in a staggered arrangement arranged to enable the printheads in both units to emit ink drops in a continuous line across the width of media path P at a predetermined resolution. In the example of FIG. 1, print sub module 140 is configured to emit ink drops in a twenty inch wide path that includes both the first and second sections of the media web at a resolution of 300 dots per inch. Ink ejectors in each printhead in print units 144 and 146 are configured to eject ink drops onto predetermined locations of both the first and second sections of media web 114. Print module 102 also includes sub module 142 that has the same configuration as sub module 140, but has a cross-process alignment that differs from sub module 140 by one-half of a pixel. This enables printing system 100 to print with twice the resolution as provided by a single print sub module. In the example of FIG. 1, sub modules 140 and 142 enable the printing system 100 to emit ink drops with a resolution of 600 dots per inch. Each of other print modules 104-112 may be similarly configured for duplex printing.

Operation and control of the various subsystems, components and functions of printing system 100 are performed with the aid of a controller 128 and memory 129. In particular, controller 128 monitors the velocity and tension of the media web 114 and determines timing of ink drop ejection from the print modules 102, 104, 106, 108, 110, and 112. The controller 128 may be implemented with general or specialized programmable processors that execute programmed instructions. Controller 128 is operatively connected to memory 129 to enable the controller 128 to read instructions and read and write data required to perform the programmed functions in memory 129. Memory 129 may also hold one or more values that identify tension levels for operating the printing system with at least one type of print medium used for the media web 114. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

Encoders 160, 162, and 164 are operatively coupled to preheater roll 118, apex roll 120, and leveler roll 122, respectively. Each of the encoders 160, 162, and 164 are velocity sensors that generate an angular velocity signal corresponding to an angular velocity of a respective one of the rolls 120, 118, and 122. Typical embodiments of encoders 160, 162, and 164 include Hall effect sensors configured to generate signals in response to the movement of magnets coupled to the rolls and optical wheel encoders that generate signals in response to a periodic interruption to a light beam as a corresponding roll rotates. Controller 128 is operatively coupled to the encoders 160, 162, and 164 to receive the angular velocity signals. Controller 128 includes hardware circuits or software routines that identify a linear velocity of each of the rolls 120, 118, and 122 using the generated signals and a known radius for each roll.

Tension sensors 152A-152B, 154A-154B, and 156A-156B are operatively coupled to a guide roll 117, apex roll 120, and post-leveler roll 123, respectively. The guide roll 117 is positioned on the media path P prior to the preheater roll 118, and the post-leveler roll 123 is positioned on the media path P after the leveler roll 122. Each tension sensor generates a signal corresponding to the tension force applied to the media web at the position of the corresponding roll. Each tension sensors may be a load cell that is configured to generate a signal that corresponds to the mechanical tension force between the media web 114 and the corresponding roll. In the embodiment of FIG. 1 where two sections of the media web 114 engage each roll in tandem, each of the tension sensors are paired to identify the tension on each section of the media web 114. In embodiments where one surface of the media web engages each roll, a single tension sensor may be used instead. Tension sensors 152A-152B generate signals corresponding to the tension on the media web 114 as the media web 114 enters the print zone passing print modules 102-112. Tension sensors 154A-154B generate signals corresponding to the tension of the media web around apex roll 120 at an intermediate position in the print zone. Tension sensors 156A-156B generate signals corresponding to the tension of the media web around leveler roll as the media web 114 exits the print zone. The tension sensors 152A-152B, 154A-154B, and 156A-156B are operatively coupled to the controller 128 to enable the controller 128 to receive the generated signals and monitor the tension between apex roll 118 and the media web 114 during operation.

In operation, controller 128 measures the tension of the media web 114 at the guide roll 117, apex roll 120, and post-leveler roll 123. The velocity of the web 114 is measured on the preheat drum 118, apex roll 120, and leveler drum 122. The controller 128 is configured to identify slip between the media web 114 and the apex roll 120 when velocity variations between the tensions and linear velocities between the apex roll 120 and one or both of the preheat or leveler drums 3 exceed a predetermined threshold. The controller 128 adjusts the tension level applied to the media web 114 when slippage between the media web 114 and the apex roll 122 is identified. The controller 128 may be configured to identify media web slip and apply tension to the media web in accordance with the processes of FIG. 3 and FIG. 4 described below.

Figure 2:
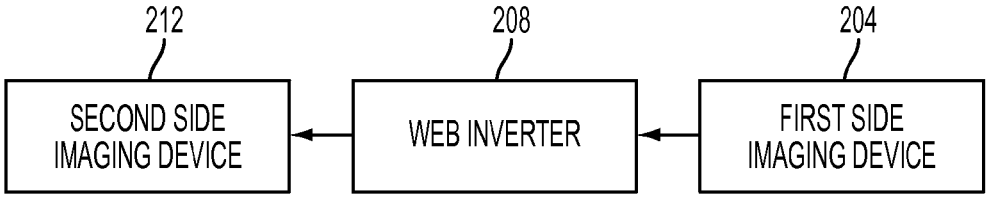
FIG. 2 is a block diagram of a two continuous web printing systems that are configured for duplex printing.

FIG. 2 depicts an alternative configuration of printing devices into a system for duplex printing on a continuous media web. The system 200 includes a first side imaging device 204, web inverter 208, and second side imaging device 212. The first side imaging device 204 and second side imaging device 212 are both simplex web imaging devices similar to the system 100, with the exception that the imaging devices 204 and 212 each form images on one side of a media web that passes through each imaging device a single time. The media web travels through the first side imaging device 204 where a first side of the media web is imaged, the media web then travels through a web inverter 208 that orients the non-imaged side to be imaged in the second imaging device 212. Unlike the embodiment of FIG. 1, the pre-heater roll and apex roll in each of the imaging devices 204 and 212 contact only a single section of the media web. Thus, each roll in the first imaging device 204 contacts a bare surface of the media web, while the apex and backer bar rolls, and leveler roll in the second imaging device 212 contact the imaged surface of the media web formed by the first imaging device 204. The preheater rolls in both the first side imaging device 204 and second side imaging device 212 contact a bare surface of the media web.

Figure 5B:
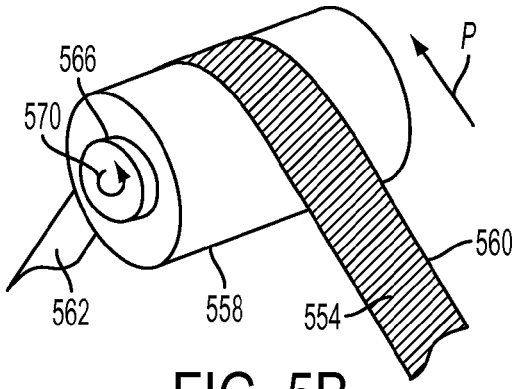
FIG. 5B is a depiction of a capstan roll configured to contact a bare surface of a media web in the simplex engine prior to duplex engine configurations.
Figure 5C:
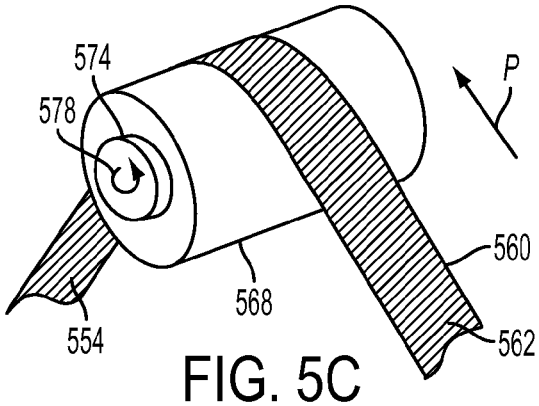
FIG. 5C is a depiction of a capstan roll configured to contact a printed surface of a media web in the duplex engine.

FIG. 5B depicts an apex roll in the first imaging device 504 of FIG. 2, and FIG. 5C depicts an apex roll in the second imaging device 212 of FIG. 2. FIG. 5B includes apex roll 558, bearing 566, and media web 560 with a bare side 562 and imaged side 554. Apex roll 558 engages the bare side 562 of media web 560 as media web 560 travels along media path P. Apex roll 558 is configured to rotate about bearing 566 in direction 570 in response to a force applied by the media web 560. FIG. 5C includes an apex roll 568, bearing 574, and media web 560 with side 554 engaging the apex roll 568. The imaged side 554 of media web 560 engages apex roll 568. Apex roll 568 is configured to rotate about bearing 574 in direction 578 in response to the force applied by media web 560. As mentioned above, the coefficient of friction between the apex roll 558 and the bare side 562 of the media web 560 differs from the coefficient of friction between the apex roll 568 and the imaged side 554 of the media web 560. The static and dynamic frictional forces of bearings 566 and 574 may differ as well.

Figure 3:
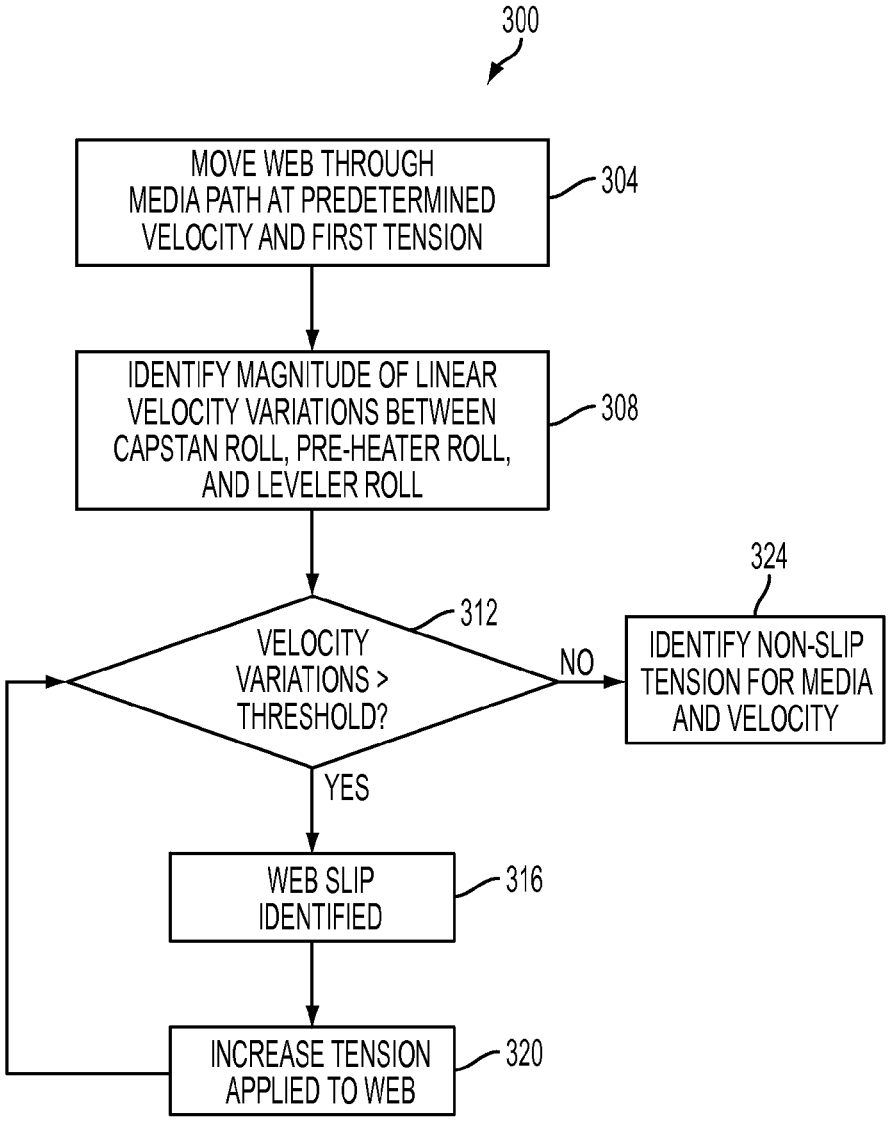
FIG. 3 is a flow diagram of a method for identifying a tension level between a capstan roll and a media web in a continuous web printing system where the media engages the capstan roll without slipping.

FIG. 3 depicts a process 300 for monitoring slip in a media web and for adjusting the tension applied to the web during operation of a printing system. In process 300, a continuous media web imaging system, such as systems 100, 204, and 212 described above, moves a continuous media web through a media path at a predetermined velocity and tension (block 304). The predetermined velocity is selected to match an operational velocity that the media web may travel through the printing system in at least one operating mode. A first tension level is selected with an estimated tension level that enables the media web to slip when engaging the apex roll. In some printing system embodiments, including the printing system embodiments of FIG. 1 and FIG. 2, identifying web slip over the apex roll provides an indication of whether or not the web is slipping on other rolls positioned on the media path. When the web engages the apex roll without slipping, the level of tension on the web is also sufficient to prevent slipping between the media web and other rolls in the printing system.

Process 300 identifies the magnitude of differences in linear velocity between the pre-heater roll, apex roll, and leveler roll (block 308). In a printing system where the media web engages the pre-heater roll, apex roll, and leveler roll without slipping, each of the rolls have approximately equivalent linear velocities, and those linear velocities are also approximately equivalent to the linear velocity of the media web. As mentioned above, in the mobius web printer system 100, some degree of slip between the apex roll 120 and sections 502A and 502B of the media web 114 occurs during operation. Thus, some differences between the velocity of the pre-heater roll, apex roll, and leveler roll may occur during operation. If, however, process 300 identifies that the magnitudes of differences in the measured linear velocities at the pre-heater roll, apex roll, and leveler roll exceed a predetermined threshold (block 312), then process 300 identifies that the web is slipping when engaged with the apex roll (block 316). In one embodiment, the predetermined velocity variation threshold is 10% of the magnitude of the apex roll linear velocity at steady state speed.

In response to identifying web slip, the printing system applies additional tension to the media web (block 320). Various tensioning devices, which may include adjustable dancer rolls, are configured to increase the tension applied to the media web. The increase in tension may be applied in predetermined increments. Process 300 may measure differences in roll velocity (block 312), identify web slip (block 316), and increase web tension (block 320) in an iterative manner until the magnitude of velocity variations between the apex roll, pre-heater roll, and leveler roll drops below the predetermined threshold. The web tension level that enables the web to engage the rolls without slipping is identified, and may be stored in a memory within the printing system in association with a linear velocity for the web (block 324). FIG. 3 depicts process 300 in a manner where the media web slips over an apex roll until increases in the web tension eliminate the slip. An alternative process may apply a tension to the media web where the media web does not slip, and incrementally reduce the tension applied to the media web until the media web slips over the apex roll. Both variations of process 300 identify a tension level between the apex roll and the media web that enables the media web to engage the apex roll without slipping.

Process 300 may be performed multiple times with various types of media and different linear velocities to identify media web tensions that enable the media web to engage rolls in the printing system without slipping. These identified media web tensions are stored in the memory in association with the various types of media and linear velocities for which they were identified. Different media web weights and compositions have different coefficients of friction when engaging rolls in the printing system. Additionally, the dynamic friction between the media web and the rolls changes at different velocities, so the non-slip tension is identified for each operating velocity that the printing system uses. Process 300 identifies a tension between the apex roll and media web that is at or near a minimum tension level that enables the media web to engage the apex roll without slipping. While the rolls may engage the roll at a higher tension level, increased contact pressure between the apex roll and the media web may result in ink from the media web adhering to the surface of the apex roll. This adhesion of ink to the apex roll is also referred to as offset. Thus, the process 300 identifies a tension level that prevents slip while reducing the occurrences of ink offset between the media web and rolls.

In addition to identifying non-slip tension with respect to the material comprising the media web, process 300 may also identify separate tension levels that eliminate web slip for bare media and for media with one or more levels of ink coverage on the surface of the media web that engages the rolls. In some operating modes, each roll may engage a bare media surface, a media surface bearing ink images, or a tandem engagement where both the bare and image bearing media surfaces engage the roll. As already noted, these various tensions identified in process 300 may be stored in a memory in association with the conditions for which they were identified to enable a printing system to select a predetermined web tension for different conditions occurring with the printing system. The media type, selected linear velocity of the media, duplex and simplex printing configuration, and arrangement of bare or imaged media web surfaces that contact the roll are examples of conditions in the printing system. A printing system may periodically perform process 300 to identify one or more tension levels that eliminate web slip, or the tension levels may be identified in advance and stored in a memory in the printer. As described below, during operation the printer may make further adjustments to web tension during operation.

Figure 4:
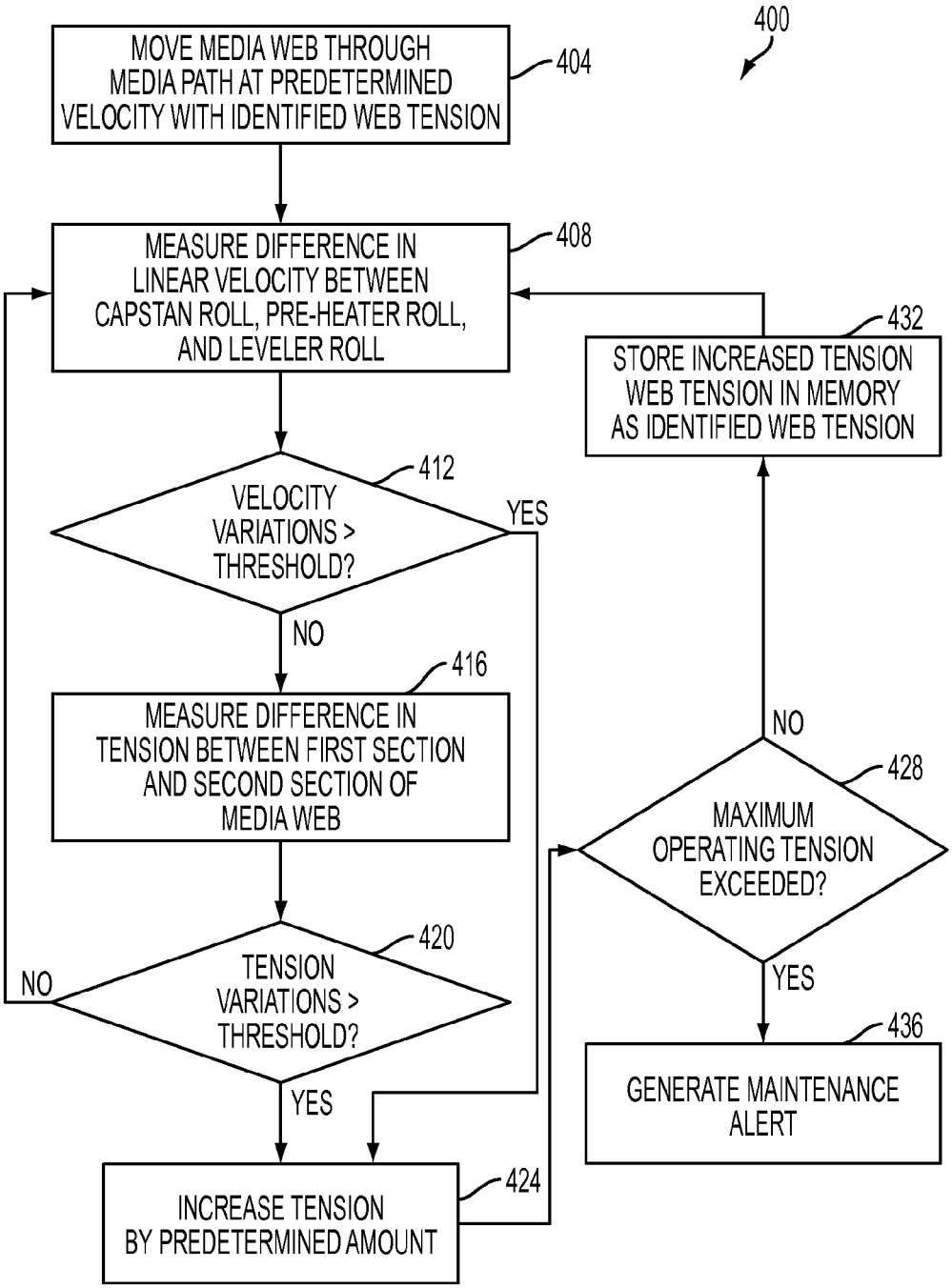
FIG. 4 is a flow diagram of a method for identifying slip between a capstan roll and a media web during operations in a web printing system and for adjusting the tension between the capstan roll and the media web.

FIG. 4 depicts a process 400 for adjusting web tension to eliminate slip during printing operations. Process 400 moves a media web through a media path in a printer at a predetermined velocity with a predetermined level of tension applied to the media web (block 404). The predetermined level of tension roll may be identified using the process 300 described above, and the printer may select the tension level with reference to the existing conditions within the printing system, such as materials used for the media web and the selected linear velocity for the media web. Process 400 identifies differences in magnitude between the linear velocities of the apex roll, pre-heater roll, and leveler roll (block 408) and compares the differences to a predetermined threshold (block 412). An exemplary embodiment of process 400 sets the predetermined threshold at 10% of the magnitude of the measured linear velocity of the apex roll.

If the velocity variations are within the predetermined threshold, process 400 may optionally measure variations in the tension between two sections of the web on the media path (block 416). In printing system embodiments where two sections of a media web engages a roll in tandem, such as shown in FIG. 1 and FIG. 5A, tension sensors may measure the magnitudes of tension on each section of the media web on the same roll. Variations in tension between the two sections of the media web may indicate that one section of the media web is slipping while the other section is not. In the example of FIG. 5A, certain tension levels may enable the bare print medium 508 to engage the apex roll without slipping, while the imaged surface 506 slips when engaging the apex roll 120. In this situation, the rotational velocity of the rolls measured in block 408 may show little or no variation since one of the media web sections engages each roll without slipping. The section of the media web that slips, however, has a different measured tension than the section of the media web that remains engaged to the apex roll without slipping. As mentioned above, in the mobius web printer system 100, some degree of slip between the apex roll 120 and sections 502A and 502B of the media web 114 may occur during operation. If, however, the magnitude of the differences in tension and corresponding slip grow too great, the accuracy of ink drop registration and image quality suffers. Thus, if the differences in tension between the two sections of the media web exceed a predetermined threshold (block 420), process 400 identifies web slip.

The measurements of relative roll velocity and web tension may occur in any order or concurrently. In the event that variations in roll linear velocity exceed the predetermined threshold (block 412) or that the measured differences in tension between two sections of the web exceed the predetermined threshold (block 420), process 400 increases the tension applied to the web by a predetermined amount (block 424). The tension may be increased until the tension level exceeds a maximum tension level for the media web in the printer (block 428). The maximum operating tension refers to the maximum tension that may be applied to a given media web while maintaining acceptable operating parameters such as maintaining an acceptable frequency of web breakage. In an exemplary embodiment, the maximum operating tension is less than or equal to 20% of a known maximum breaking strength for a selected print medium material to avoid yield and breakage. Tension levels above the maximum operating tension level greatly increase the likelihood of the media web deforming or breaking, which interrupts printing operations. Maximum operating tensions are empirically determined for various types of media, and may vary with different factors including the curvature of the media path and linear velocity of the media web through the media path. While each media web has a predetermined maximum operating tension, applying a tension level below the maximum level that enables the media web to engage the rolls without slipping further reduces the likelihood of web breakage, and reduces the occurrence of ink offset from the media web to rolls in the printer.

In the increased tension exceeds the maximum operating tension for the media web (block 428), the printing system may generate an alert to request maintenance (block 436). Various printer components experience wear during operation that may promote slip of the media web on the rollers. In printing systems where imaged portions of the media web contact the rolls, some ink may offset to the surface of each roll and eventually require roll cleaning. The alert may request any form of maintenance that restores the printing system to a condition where the media web may engage the rolls without slipping.

When the increased tension level is below the maximum operating tension level for the media web (block 428), the increased tension level applied to the media web is stored in a memory (block 432). The stored tension level is associated with the type of media being imaged, and with the operating linear velocity of the media web in the printing device. The stored tension level may replace the previously identified tension level that enables the media web to engage the rolls without slipping. Once the web tension is increased, process 400 continues to monitor roll velocity and web tension to identify slip.

It will be appreciated that variants of the above-disclosed and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the following claims.

What is claimed:

1. A method of adjusting operation of a printing system comprising:

identifying a plurality of tension levels for at least one roll positioned along a media web path through the printing system, one of the tension levels being identified with reference to a slip condition occurring between and bare media alone, one of the tension levels being identified with reference to a slip condition occurring between the at least one roll and media carrying one or more levels of ink alone, and one of the tension levels being identified with reference to a slip condition occurring between the at least one roll and both bare media and media carrying at least one level of ink contacting the at least one roll simultaneously; and storing each identified tension level for the at least one roll in a memory of the printing system, each identified tension level being stored, respectively, in association with bare media alone, media carrying one or more levels of ink alone, and bare media and media carrying at least one level of ink contacting the at least one roll simultaneously.

2. The method of claim 1 further comprising:

detecting occurrence of the slip conditions by identifying a difference between a linear velocity of the at least one roll and a linear velocity of another roll positioned along the media path.

3. The method of claim 2, the detection of the slip condition further comprising:

decreasing a tension level applied to the at least one roll until the media contacting the at least one roll slips with reference to the at least one roll.

4. The method of claim 2, the detection of the slip condition further comprising:

increasing a tension level applied to the at least one roll until slippage between the at least one roll and the media contacting the at least one roll reaches a predetermined minimum.

5. A printing system comprising:

at least one roll positioned proximate to a media path through the printing system along which a media web moves through the printing system, the at least one roll being configured to contact the media web and rotate in response to movement of the media web;

a tension sensor operatively coupled to the at least one roll, the tension sensor being configured to generate a signal corresponding to a tension level applied by the at least one roll to the media web;

a memory; and a controller operatively coupled to the tension sensor, the at least one roll, and the memory, the controller being configured:

(a) to adjust a tension level applied to the at least one roll to identify a tension level with reference to a slip condition between the at least one roll and bare media alone, (b) to adjust a tension level applied to the at least one roll to identify a tension level with reference to a slip condition between the at least one roll and media carrying one or more levels of ink alone, (c) to adjust a tension level applied to the at least one roll to identify a tension level with reference to a slip condition between the at least one roll and both bare media and media carrying at least one level of ink that contact the at least one roll simultaneously, and (d) to store each identified tension level for the at least one roll in the memory in association, respectively, with the bare media alone, the media carrying one or more levels of ink alone, and both the bare media and the media carrying at least one level of ink that contacts the at least one roll simultaneously.

6. The printing system of claim 5 further comprising:

a first velocity sensor configured to generate a signal corresponding to an angular velocity of the at least one roll;

a second velocity sensor configured to generate a signal corresponding to an angular velocity of another roll positioned proximate to the media path; and the controller is operatively coupled to the first velocity sensor to identify the linear velocity of the at least one roll with reference to the signal corresponding to the angular velocity of the at least one roll and is operatively coupled to the second velocity sensor to identify the linear velocity of the other roll with reference to the signal corresponding to the angular velocity of the other roll during an imaging operation of the media web, the controller being further configured to detect each slip condition with reference to a difference between the linear velocity of the at least one roll and the linear velocity of the other roll.

7. The printing system of claim 6, the controller being further configured to adjust a tension level applied to the at least one roll by:

decreasing a tension level applied to the at least one roll until slippage between the at least one roll and the media contacting the at least one roll commences.

8. The printing system of claim 6, the controller being further configured to adjust a tension level applied to the at least one roll by:

increasing a tension level applied to the at least one roll until slippage between the at least one roll and the media contacting the at least one roll reaches a predetermined minimum.

* * * * *